United States Patent [19]

Kovacs

[11] Patent Number: 4,569,178

[45] Date of Patent: Feb. 11, 1986

[54] PREFABRICATED PLASTERED PANELS FOR HOUSING

[76] Inventor: Jozsef Kovacs, 335 Kensington, Westmount, Quebec, Canada, H3Z 2H2

[21] Appl. No.: 457,481

[22] Filed: Jan. 12, 1983

[51] Int. Cl.[4] ..... E04G 21/00

[52] U.S. Cl. ..... 52/745

[58] Field of Search ..... 52/741, 742, 747, 383, 52/426, 606, 404, 745, 743, 746, 749, 750; 264/31, 36, 35, 333; 249/33

[56] References Cited

U.S. PATENT DOCUMENTS

| | | | |
|---|---|---|---|
| 1,023,526 | 4/1912 | Oliver | 52/383 |
| 1,160,340 | 11/1915 | Stretch | 52/745 |
| 1,259,698 | 3/1918 | Wilson | 52/125.5 |
| 1,280,530 | 10/1918 | Parker | 264/31 |
| 1,305,687 | 6/1919 | Burgin | 264/31 |
| 1,809,504 | 6/1931 | Carvel | 52/745 |
| 1,930,984 | 11/1930 | Schulz . | |
| 2,020,908 | 11/1935 | Scammell . | |
| 2,222,037 | 11/1940 | Lafferty | 52/745 |
| 2,596,914 | 5/1952 | Piacentino | 52/602 |
| 2,648,316 | 8/1953 | Marshall . | |
| 2,782,465 | 2/1957 | Palmer, Jr. | 52/747 |
| 3,363,371 | 1/1968 | Villalobos . | |
| 3,484,514 | 12/1969 | Longinotti | 264/333 |
| 3,640,038 | 2/1972 | Heron | 52/741 |
| 3,641,724 | 2/1972 | Palmer . | |
| 3,712,825 | 1/1973 | Yocum | 52/741 |
| 4,011,705 | 3/1977 | Vanderklaauw | 52/745 |
| 4,052,825 | 10/1977 | Larsson | 52/747 |
| 4,292,775 | 10/1981 | Howard . | |
| 4,330,921 | 5/1982 | White, Jr. . | |

FOREIGN PATENT DOCUMENTS

| | | | |
|---|---|---|---|
| 858166 | 12/1970 | Canada . | |
| 864754 | 3/1971 | Canada . | |
| 2505906 | 11/1982 | France | 52/404 |

*Primary Examiner*—John E. Murtagh
*Assistant Examiner*—Andrew Joseph Rudy
*Attorney, Agent, or Firm*—Schwartz, Jeffery, Schwaab, Mack, Blumenthal & Evans

[57] ABSTRACT

A method of construction of prefabricated plastered panels for housing, which comprises the steps of installing a rigid framework comprising a plurality of spaced apart studs onto a horizontal surface, filling up the spaces between the studs with a granular material such as sand, stretching and fixing a reinforcing material such as wire mesh, onto the upper surface of the framework, applying a layer of plastering material such as a plaster, stucco or cement onto the reinforcing material, using the granular material as formwork to support the plastering material until it is dry; and removing the framework with the dry plaster layer attached thereto from the horizontal surface. This method is particularly interesting in that it does not request any equipment for the construction of the prefabricated plastered panels. Moreover it does not request skilled labor and it makes use of low cost materials only.

14 Claims, 10 Drawing Figures

PREFABRICATED PLASTERED PANELS FOR HOUSING

The present invention relates to a method of construction of prefabricated plastered panels for housing, and to a method for erecting prefabricated buildings from a plurality of prefabricated plastered panels constructed in accordance with the invention.

Numerous methods are already known for the construction of prefabricated plastered panels of the type comprising an internal framework supporting a wire mesh coated with a plastering material. Such known methods are disclosed, by way of example, in Canadian Pat. Nos. 858,166 and 864,754 and in U.S. Pat. Nos. 1,930,984; 2,020,908; 2,648,316; 3,363,371; 3,641,724; 4,292,775 and 4,330,921.

A first object of the present invention is to provide a new method of construction of prefabricated plastered panels of the above-mentioned type, which method makes use of low cost materials usually available in abundance every where all around the world, including the developing countries, with a minimum or even no imported or expensive materials.

Another object of the present invention is to provide a method of construction of prefabricated plastered panels of the above-mentioned type, which is very easy to put into practice, even when use is made of non-skilled labour such as the one traditionally available in most if not all countries.

The method of construction of prefabricated plastered panels for housing according to the invention basically comprises the following sequence of steps:

installing a rigid framework comprising a plurality of spaced apart studs onto a horizontal surface;

filling up the spaces between the studs with a granular material such as sand;

stretching and fixing a reinforcing material such as wire mesh, onto the upper surface of the framework;

applying a layer of plastering material such as a plaster, stucco or cement onto the reinforcing material, using the granular material as formwork to support the plastering material until it is dry; and removing the framework with the dry plaster layer attached thereto from the horizontal surface.

In accordance with a preferred embodiment of the invention, the above method may also comprise the additional steps of:

turning over the framework removed from the horizontal surface with the dry plaster layer attached thereto; and repeating the same sequences of steps as above to provide another dry plaster layer onto the other surface of the framework.

In accordance with another preferred embodiment of the invention, the method may further comprise the additonal steps of providing at least one built-in opening such as a door or a window in the framework, onto which opening no plastering material is applied, and/or incorporating electrical, plumbing or piping components into the framework before or after the spaces are filled up.

As can be easily understood, the method according to the invention is particularly interesting in that it does not request any equipment for the construction of the prefabricated plastered panels. Moreover it does not request skilled labour and it makes use of low cost materials only.

Due to the fact that the construction of the panels is carried out on a horizontal surface, the plastering material can be applied in one operation instead of the two or three necessary if this is done on a vertical surface or on an upside down horizontal surface like a ceiling.

Furthermore, the use of a granular material as "formwork" to support the plastering material when the same is applied onto the reinforcing material is particularly interesting since sand is a building material which is available in abundance everywhere, easy to work with and inexpensive and which can be handled by unskilled labour. The use of sand allows the incorporation into the panel of any electrical, plumbing or piping component without special preparation as it flows around any shape while still providing the necessary support to the plaster. Instead of sand, use can be made of any other natural or man-made granular materials.

The granular material captured between the two layers of plastered material can be removed therefrom or left therein. In the latter case, the sand which fills the cavities of the panels once they are erected, provides for excellent heat retention, a characteristic which is of a great importance in hot and humid climates. The resulting wall section is solid without cavities and its characteristics are similar to the earth or mud-walled dwellings used formerly by some native people as far as heat retention is concerned.

In this connection, it should be noted that in some part of the world, sand is not readily available but laterite is. Laterite is a reddish granular alluvial deposit found in Africa, which contains silt and clay. This material can be used to fill up the wall cavities and has the advantage of "naturally" hardening into a solid mass after drying without having to mix it with cement.

Another essential advantage of the method according to the invention is the fact that the panel can be fabricated horizontally under open sky conditions, that is without cover, since the rain cannot damage the panels. In fact, the prefabrication of the panels can take place at location where the housing is to be built, right next to the foundation or on top of it if need be. Ideally, the wood framework and all incorporated, cast-in elements such electrical turbine, panel junction boxes, switches, plumbing or piping, should however be preassembled at a centralized location since quality control is most important at this stage.

The plastering operation does not require the same degree of quality control and it can be done anywhere. However, to save on transport costs, it should be done as close as possible to the erection site. This of course depends on the number of houses to be erected at this particular location. Therefore, it is governed by economic considerations rather than technical ones.

Of course, the size of the panel can be varied to suit the structure and the available means of handling it (manual or by crane).

The panels constructed by the method according to the invention are relatively light when the granular material is removed since they are void inside. This of course facilitates transport and handling. However, once they are installed, they can be filled up and then become heavy full walls, bearing or not, or simple partition walls as required.

Eventual repairs and modifications can be easily undertaken in substantially the same manner as they are done for traditional masonry structures.

Ceilings can also be produced by the method according to the invention. The so produced ceilings have the advantages of being uniform, monolithic and having considerable heat retention characteristics. Moreover, as the walls, they can be easily repaired or modified.

The surfaces of the panels can be painted or can receive a more permanent surface finishing as required.

A further object of the invention is to provide a method for erecting a prefabricated building using low cost material and non-skilled labour. This method basically comprises the steps of:

constructing a plurality of prefabricated plastered panels by carrying out the sequence of steps recited previously while taking care of sizing the reinforcing material used during the construction so that it extends laterally the surfaces of the framework of each wall panel;

erecting these prefabricated plastered panels in vertical position onto a foundation according to a predetermined room lay-out while taking care of overlapping the surfaces of the reinforcing material laterally extending the panels that are adjacent to each other;

applying a layer of plastering material onto the overlapping surfaces of reinforcing material to achieve joint connection of the adjacent panels; and mounting a roof over the so erected structure.

In accordance with a preferred embodiment of the invention, this method of erecting a building may further comprise the steps of pouring a filling material such as the sand and cement mixture known as "soil cement" and widely used as raw building material to provide subbases for road structure, between the overlapping surfaces of reinforcing material to fill up and simultaneously reinforce the joint connections of the erected structure. The sand and cement mixture which may comprise from 3 to 5% of cement by volume, can be poured before of after application of the layers of plastering material. It provides a joint assembly which is as strong as the panels themselves.

The present invention will be better understood with reference to the following non-restrictive description of a preferred embodiment thereof, given with reference to the accompanying drawings wherein:

FIGS. 1(*a*) to (*g*) are side-elevational, schematic views illustrating the basic sequence of steps of the method of construction of prefabricated plastered panels according to the invention;

Figure 1A:
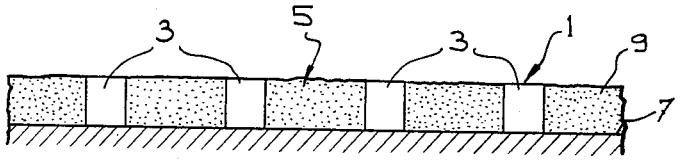
Figure 1B:
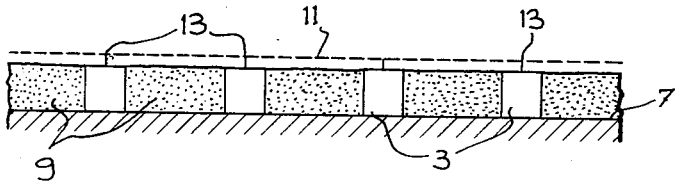
Figure 1C:
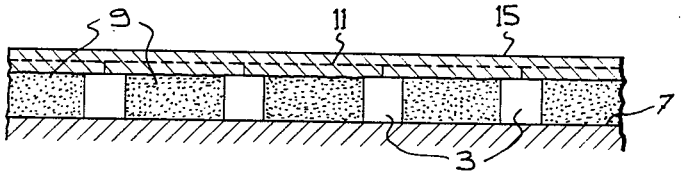
Figure 1D:
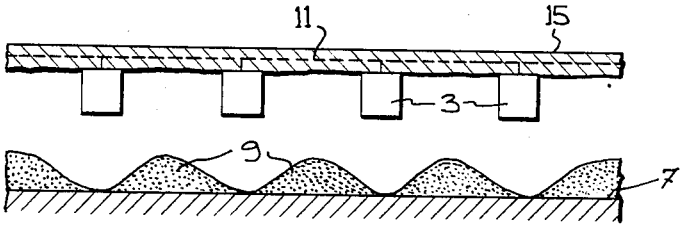
Figure 1E:
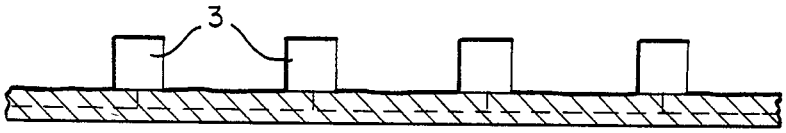
Figure 1F:
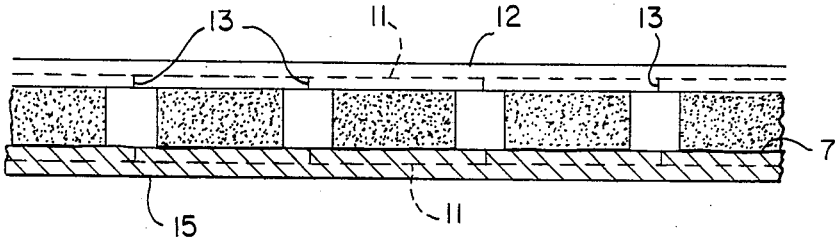
Figure 1G:
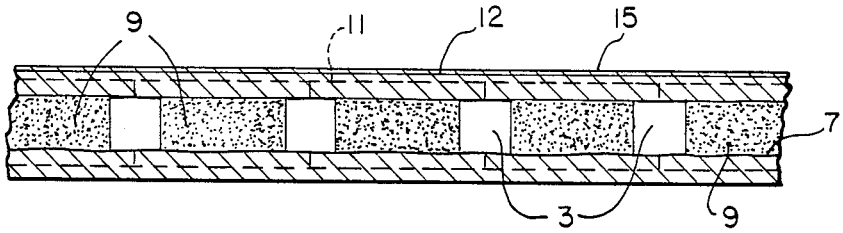

As aforesaid, the purpose of the method according to the invention is to produce prefabricated plastered panels that can be assembled together to form the interior and/or exterior, bearing or non-bearing walls of a building or of another structure.

This method can also be used to form the ceiling of the house.

As also explained hereinabove, the originality of this method lies that it can be carry out with low costs materials available almost everywhere, using non-skilled labour also available everywhere.

Referring to FIG. 1(*a*), this method first comprises the step of installing a rigid framework 1 onto a horizontal surface 7 preferably located next to the foundation of the building to be erected. Advantageously, the framework 1 can be assembled directed onto the horizontal surface 7 by placing a plurality of studs 3 at even spaces in parallel relationship. These studs can be subsequently connected to each other by fixation of spreader bars perpendicularly thereto.

After having assembled the framework 1 onto the horizontal surface 7, the spaces 5 formed between the studs 3 and the spreaders, are filled up with a granular material 9. The granular material that can be used, can be sand, since this material is very cheap and available almost everywhere.

Thereafter, a reinforcing material 11 such as wire mesh, metal lath or chicken wire, is stretched onto the upper surface of the framework 1 and fixed to the studs 3 with nails 13 or with any other fixation means, as shown in FIG. 1(*b*).

In a further step, a thick layer of plastering material such as stucco, cement, plaster or any mixture thereof, is applied directly onto the reinforcing material 11 using the sand 9 as formwork to support the plastering material until it is dry. The layer of plastering material must be thick enough to embed the reinforcing material 11, as shown in FIG. 1(*c*).

If desired, the upper surface of the plastering material may be finished with any desired texture before, during or after it is dry.

Thereafter, the framework 1 with the dry plastered layer 15 attached thereto can be removed from the horizontal surface 7 as shown in FIG. 1(*d*). The so-fabricated plastered panel is covered on one side only.

It should be noted that the sand will remain in place when the panel is removed.

If desired, the framework 1 removed from the horizontal surface with the dry plastered layer 15 attached thereto can be turned over and reinstalled onto the horizontal surface 7 after having removed therefrom the sand 9, as shown in FIG. 1(*e*). The same sequence of steps as above can then be repeated as shown in FIGS. 1(*f*) and 1(*g*) to provide another dry plastered layer onto the other surface of the framework. As an alternative construction, a layer of thin plastic roofing material 12 may cover the reinforcing material 11, as shown in FIGS. 1*f* and 1*g*.

After having repeated the same sequence of steps, the panel can be tilted up into vertical position with the sand captured between the two layers of plastering material. The sand can be left inside the panel to make it solid without cavities and thus to improve the heat retention of the same. In some countries, laterite powder can be used in place of sand. The use of such compound is particularly interesting since laterite naturally hardens to a solid mass after drying, and thus make the panel very resistant.

On the other hand, the sand captured between two layers of plastering material may be removed by lifting up the panel slightly to allow the sand to flow out around the spreaders or after having provided evacuation holes through the spreaders, if necessary.

If desired, a layer of thin plastic, roofing material (not shown) can be placed onto the stretched reinforced material to cover the same prior to applying the layer of plastering material. The presence of this layer of thin plastic material is particularly interesting in that it can serve as vapour barrier when climatic conditions require one. By using a thin plastic material of sufficient strength, the application of the plastering material onto the wire mesh, can be made without necessity to fill up again the cavities inside the panel after it has been turned over, once with a dry plastered layer attached thereto. Indeed, the thin plastic roofing material placed onto the stretched supporting wire mesh, covers the openings of this wire mesh and cooperates herewith to support the layer of plastering material subsequently applied thereto. In this case, the wire mesh and the sheet of plastic material extending thereon all together provide the formwork necessary to support the plaster.

When the framework is provided with at least one built-in opening such as a door and/or a window, of course no wire mesh and no plastering material have to be applied onto this opening. It can be easily understood that electrical, plumbing or piping component can be incorporated into the framework before or after filling up the spaces with sand, that is when the framework is still in horizontal position. This makes the construction of the prefabricated plastered panel according to the invention very easy to carry out, even with non-skilled labour.

Preferably, the reinforcing material 11 fixed onto the framework 1 is sized to extend laterally past the surface of the framework. The reasons for this lateral extension of the reinforcing material will be given hereinafter.

The prefabricated plastered panels constructed as disclosed hereinabove, are particularly interesting since they can be used for the erection of prefabricated buildings at very low cost.

For this purpose, it is first necessary to construct a plurality of prefabricated plastered panels by carrying out the above described sequence of steps. Of course, the size and shape of the panels are selected according to the desired shape and room lay out of the building to be erected.

During the construction of the prefabricated panels, it is necessary to take care of sizing the reinforcing material so that it extend laterally the surfaces of the framework of each panel.

Figure 2:
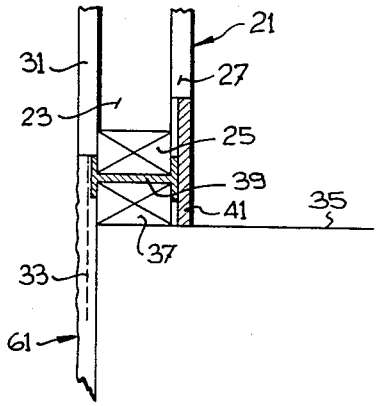
FIG. 2 is a side-elevational view of a typical joint of a wall panel to a foundation.

The way each panel can be erected onto a foundation 35 is shown on FIG. 2.

In this figure, a prefabricated plastered panel 21 is positioned adjacent to the foundation 35 of a building to be erected. The panel which comprises a framework including studs 23 connected to each other by means of spreaders 25 and acting as support for two layers of plastering material 27 and 31, is mounted onto a floor guide 37 fastened directly onto the foundation surface. If desired, a H-shaped metal guide 39 can be used for positioning the panel 21 over the guide 37. A lower spreader guide 41 also serving as baseboard, is used to finish the interior wall when the panel 21 is erected.

To finish the exterior wall, the wire mesh 33 used as reinforcing material for the plastering material 31 can be extended downwardly to the foundation 35 and attached thereto with concrete fasteners (not shown). This so-extended reinforcing mesh may subsequently be covered with the same plaster as used for the construction of the panel 21 in order to produce even homogeneous surface all around the foundation 35.

It is to be noted that the guide 37 fastened to the foundation 35 can be made of wood or concrete.

As aforesaid, the prefabricated plastered panels are erected into vertical position onto the foundation 35 according to a predetermined room lay out, and are subsequently joined to each other. To do so, the prefabricated panels must be positioned end to end while taking care of overlapping the surfaces of the wire meshes which laterally extend each panel.

Figure 4:
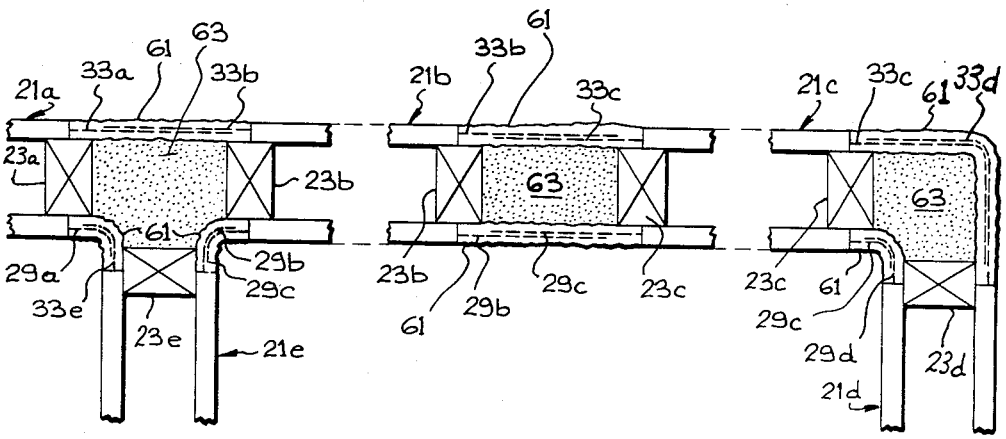
FIG. 4 is a top plan view of typical points between two or more panels according to the invention.

FIG. 4 shows five panels 21(*a*) to (*e*) positioned as described hereinabove. As shown in this figure, the wire meshes 33(*c*) and 33(*d*) laterally extending the exterior surfaces of the panels 21(*c*) and 21(*d*) are overlapped as are the wire meshes 29(*c*) and 29(*d*) extending laterally past the interior surfaces of the same panels 21(*c*) and 21(*d*) respectively. The void defined between each pair of overlapping meshes can subsequently be filled up with a mixture 63 of sand and cement preferably in the proportion of 3 to 5% by volume of cement. This mixture which already is known as "soil cement" and has already been used widely as raw building material up to now to provide road support, does not only fill up the void but also and simultaneously reinforce the joint between the panels 21(*c*) and 21(*d*). Subsequently, a layer 61 of the same plastering material as used for the construction of the panels can be applied directly onto the overlapping meshes to provide a homogeneous surface between the interior and exterior walls of the panels 21(*c*) and 21(*d*).

It should be noted that the cement mixture 63 may be poured between the overlapping surfaces of reinforcing material, before application of the layer 61 of plastering material.

Actually, the layer 61 of plastering material can be applied onto the overlapping surface of reinforcing material before or after pouring the soil cement 63. It should be noted that it is not even necessary to fill up the void between the ends of two adjacent panels. When no filler is used, the panel joint connections are each made of the two thick layers of plastering material 61 applied directly onto the overlapping wire meshes extending the lateral ends of the interior and exterior walls of the panels.

The above-mentioned method of providing homogeneous joint between two adjacent panels extending perpendicularly to each other, can be applied to panels extending end to end in line, as well as for joining three or more panels, as also shown in FIG. 4.

In this connection, it should be noted that every structural element shown in FIG. 4 and similar to another element previously described, has been identified with the same reference numeral but with a different letter indicia.

As can be easily understood, the very particular innovation in the method of erecting a building according to the invention lies in that any number of panels can be used and joined as disclosed hereinabove to erect the building. This is particularly interesting since one can select the size of the panels to suit the structure while taking into account the handling means available on the premises. Thus for example, when no crane is available, the sand used as formwork for the manufacture of every panel can be removed from between the layers of plastering material in order to keep the panel light and easily manipulable. The wall may then be erected as disclosed hereinabove both to the foundation and to each other.

If it is desirable to have solid walls for reasons of insulation or to keep insects and rodents from establishing themselves in voids inside every panel as well as the voids between the layers 61 of every joint, the void can be filled up by using any appropriate filling material available, such as clay, sand, laterite, soil cement and the like. This can be done prior to positioning the ceiling and roof to make the building easily erectable without any heavy equipment like a crane.

Once the walls have been erected, the house may be completed by positioning a ceiling 43 onto the upper ends of the panels. This ceiling 43 can be of any conventional structure, or can be made of plastered panels similar to those used for erecting the building walls.

A roof (not shown in the drawings) can be positioned over the ceiling. However, the ceiling may also act as a roof, provided that a plastering layer be located over it to act as roof for the building.

Figure 3:
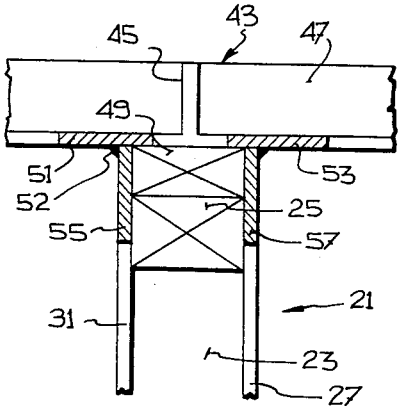
FIG. 3 is a side-elevational view of a typical joint between a wall panel and a ceiling panel.

As shown on FIG. 3, the ceiling 43 which comprises beams and joists 45 and 47, can be positioned onto the top spreader 25 of the wall panel 21, which spreader may be fixed after the panel has been erected and filled up. If necessary, a finishing alignment plate 49 can be used to adjust the height of the structure. The same joint can be completed by fixing spreader guide plates 51, 53, 55 and 57 as shown in FIG. 3 and by positioning finishing mouldings 52 at the connection between each pair of spreader guide plates.

It should be noted that the ceiling panels are to be fastened to the wall panels against vertical uplift and horizontal shear forces.

The joists of the ceiling panels can act as bottom chords for an eventual roof truss depending on the type of roof employed. Indeed, as can be easily understood, the structure described hereinabove using the prefabricated panels according to the invention, can accept any type of traditional roofing system.

Of course, many modifications and/or variants can be brought to the methods described hereinabove for the construction of prefabricated plastered panels and for the erection of buildings from such panels, without abandoning the outline of the present invention as delimitated in the following claims.

The embodiments of the invention in which an exclusive property or privilege is claimed are defined as follows:

1. A method of construction of a prefabricated plastered panel for housing, comprising the following sequence of steps:

installing a rigid framework comprising a plurality of spaced apart studs onto a horizontal surface, said framework having a pair of opposite surfaces, one of said opposite surfaces being in contact with the horizontal surface and one of said surfaces being exposed;

filling up the spaces between the studs with a loose granular material;

stretching and fixing a reinforcing material onto the exposed surface of the framework;

applying a layer of plastering material onto the reinforcing material, using the granular material as formwork to support the plastering material until it is dry;

removing the framework with the dry plaster layer attached thereto from the horizontal surface, and permitting the loose granular material to fall from said spaces whereby said panel is light in weight and easy to handle due to the removal of the granular material;

turning over the framework removed with the dry plaster layer attached thereto such that the opposite surface is exposed; and repeating the steps of: filling up the spaces between the studs with a loose granular material; stretching and fixing a reinforcing material onto the exposed surface of the framework; and applying a layer of plastering material onto the reinforcing material, using the granular material as formwork to support the plastering material until it is dry to provide another dry plaster layer onto the other surface of the framework.

2. The method of claim 1, further comprising:

removing the granular material captured between the two layers of plastering material.

3. The method of claim 2, further comprising:

assembling the framework directly onto the horizontal surface by placing the studs in parallel relationship onto said horizontal surface and subsequently connecting said studs altogether by fixation of spreader bars thereto.

4. The method of claim 2, further comprising:

placing onto the stretched reinforcing material, a layer of thin plastic, roofing material to cover the said reinforcing material prior to applying the layer of plastering material.

5. The method of claim 2, wherein:

the framework is made of wood;

the reinforcing material consists of a wire mesh fixed with nails onto the framework; and the plastering material is selected from the group consisting of plaster, stucco and cement.

6. The method of claim 2, further comprising:

providing at least one built-in opening in the framework, onto which no plastering material is applied.

7. The method of claim 2, further comprising:

incorporating electrical, plumbing or piping components into the framework before or after the space filling-up step.

8. The method of claim 2, wherein the reinforcing material fixed onto the framework is sized to extend laterally past the surface of the framework.

9. A method for erecting a prefabricated building using low-cost materials and non-skilled labour, comprising the steps of:

constructing a plurality of prefabricated plastered panels by carrying out the sequence of steps recited in claim 2 while taking care of sizing the reinforcing material used in this construction so that said reinforcing material extends laterally past the surfaces of the framework of each panel;

erecting these prefabricated plastered panels in vertical position onto a foundation according to a predetermined room lay-out while taking care of overlapping the surfaces of the reinforcing material laterally extending the panels that are adjacent to each other;

applying a layer of plastering material onto the overlapping surfaces of reinforcing material to achieve joint connection of the adjacent panels; and mounting a roof over the so erected structure.

10. The method of claim 9, further comprising:

pouring a filling material between the overlapping surfaces of reinforcing material to fill up and simultaneously reinforce the joint connections of the erected structure.

11. The method of claim 10, wherein the filling material is a mixture of sand and cement comprising from 3 to 5 percent of cement by volume.

12. The method of claim 11, wherein the filling material is poured before application of the layers of plastering material.

13. The method of claim 11, wherein the filling material is poured after application of the layer of plastering material.

14. The method of claim 10, further comprising:

fastening at least one prefabricated plastered panel similar to those already erected onto the foundation over the erected structure to form a ceiling prior to mounting the roof.

* * * * *